9/2/80 XR 4,220,205

United States Patent [19]

Coursen et al.

[11] 4,220,205

[45] Sep. 2, 1980

[54] METHOD OF PRODUCING SELF-PROPPING FLUID-CONDUCTIVE FRACTURES IN ROCK

[75] Inventors: David L. Coursen, Mercersburg, Pa.; George R. Cowan, Woodbury, N.J.

[73] Assignee: E. I. Du Pont de Nemours and Company, Wilmington, Del.

[21] Appl. No.: 964,426

[22] Filed: Nov. 28, 1978

[51] Int. Cl.[2] ..... E21B 43/26

[52] U.S. Cl. ..... 166/299; 166/250; 166/308

[58] Field of Search ..... 166/308, 250, 299, 259, 166/271, 280, 281, 283; 102/23

[56] References Cited

U.S. PATENT DOCUMENTS

| | | | |
|---|---|---|---|
| 3,002,454 | 10/1961 | Chesnut | 166/308 UX |
| 3,586,105 | 6/1971 | Johnson et al. | 166/308 X |
| 3,616,855 | 11/1971 | Colgate | 166/308 X |
| 3,835,928 | 9/1974 | Strubhar et al. | 166/308 |
| 3,878,884 | 4/1975 | Raleigh | 166/308 X |
| 3,933,205 | 1/1976 | Kiel | 166/308 |
| 3,934,649 | 1/1976 | Pasini et al. | 166/308 X |
| 4,005,750 | 2/1977 | Shuck | 166/308 |

*Primary Examiner*—Stephen J. Novosad

[57] ABSTRACT

A fracture that conducts fluid within the confines of an underground rock formation without the need for particulate proppant materials to hold opposing fracture faces apart is created by a method in which a long portion of a hole drilled into the formation has its axis slanted with respect to the directions of the principal stresses, and is pressurized rapidly over its entire length with fluid, preferably by detonating an explosive therein.

A hypothetical fracture plane is defined as that plane containing the axis of the hole which is under the least compressive normal stress. When the orientation of the hole axis is such that there is a substantial shear stress on the hypothetical fracture plane, but the normal stress thereon does not greatly exceed the minimum principal stress, the fracture created lies close to the hypothetical fracture plane, and is conductive to fluids. The fracture is conductive because it is held open by the misfit between the opposing faces which arises from the shear displacement of the faces that occurs when the existing shear stress is released by the formation of the fracture.

10 Claims, 5 Drawing Figures

METHOD OF PRODUCING SELF-PROPPING FLUID-CONDUCTIVE FRACTURES IN ROCK

BACKGROUND OF THE INVENTION

1. Field of the Invention

The present invention relates to a method of producing fluid-conductive fractures within a rock formation, useful in processes in which gases or liquids are to be injected into, or removed from, the formation, e.g., for the recovery of fuels, minerals, or energy therefrom.

2. Description of the Prior Art

There are a number of situations in which important economic benefit can be obtained by opening up subterranean pathways which are capable of conducting the flow of liquids and gases. Such pathways have been extensively used to increase the production of oil and gas from wells drilled into oil-containing and gas-containing formations. Such formations are often stimulated by fracturing treatments usually to produce an increase in the flow of oil or gas to the well. A number of other processes which are expected to become economically important in the future also require conductive pathways in the ground. The in situ leaching of minerals requires paths for the leaching fluid to contact the minerals. The in situ combustion of oil shale and the in situ gasification of coal similarly require pathways for air injection and product recovery. There is a proposed process for obtaining geothermal energy from hot dry rock by injecting cold water into one well and extracting hot water or steam from a second well; again a conducting pathway between the two holes is required.

In the past, explosives lowered into boreholes in the formation were used to fracture rock and thereby stimulate production of wells. More recently, the technique known as hydrofracturing has largely replaced explosive stimulation techniques. In hydrofracturing, a liquid is pumped into an isolated section of a borehole to a high enough pressure to fracture the formation. Further liquid is pumped in to enlarge the fracture.

In hydrofracturing, the usual result is a vertical fracture extending from the well-bore, the normal to the fracture plane being in the direction of the least compressive principal stress. Such a fracture (with its normal in line with a principal stress) closes up when the pressurizing fluid is allowed to escape. In order to hold the fractures open, a proppant such as coarse sand has been carried into the formation by suspension in the fracturing liquid. This procedure entails high power requirements to pump the suspension. Also even with much ingenuity in suspending and transporting proppant, part of the fracture area, especially that farther from the hole, cannot be reached by proppant, and thus is non-conductive. Nevertheless, the technique is more effective than conventional explosive fracturing techniques when performed in formations of limited thickness owing to the fact that hydrofracturing produces a conductive fracture which extends farther into the formation from the well.

The effectiveness of hydrofracturing generally has been limited to use in thin formations because the limitations of available power sources have not permitted the fracture-formation process to be controlled in a manner such that the fracture can extend itself reasonably far into thick formations. In explosive fracturing, a highly fractured, conductive cylindrical zone forms around the explosive, which provides the improvement in fluid flow. The high-pressure explosive gases also cause the formation of large fractures which, like hydrofractures, are perpendicular to the least compressive principal stress, and close up when the explosive pressure has been dissipated. Although these fractures may extend several times as far from the borehole as the radius of the highly fractured zone, they make no contribution to the improvement of flow.

A method of producing a conductive fracture especially in formations of greater thickness, and without the need of introducing proppant materials, would offer a decided advantage in terms of more effective fuel, mineral, and energy recovery.

SUMMARY OF THE INVENTION

The present invention provides a method of producing fluid-conductive fractures within an underground formation under tectonic stress comprising:

(a) drilling a hole into the formation so that a long portion of the hole in a zone to be fractured has an axial orientation that is slanted with respect to the directions of the principal stresses existing in the formation, the orientation being selected to place the hypothetical fracture plane, defined as that plane containing the hole axis which has the least normal compressive stress acting on it, under a substantial shear stress and under a normal compressive stress which does not greatly exceed the minimum principal tectonic stress; and (b) pressurizing the long oriented portion of the hole rapidly over its entire length with fluid, preferably by explosive means.

The conductivity of the fracture produced in the method of the invention results from the fact that the normal to the fracture plane makes oblique angles with the principal stresses in the formation. The release of the shear stress on that plane caused by the fracture leads to a shear displacement between the opposing faces of the fracture. Misfit between the displaced faces holds them apart when the fracturing pressure is released. Control of the orientation of the fracture is derived from the pressurization of a length of slanted hole commensurate with the transverse extent of the fracture and on a sufficiently rapid supply of fluid under pressure to produce uniform transverse growth of the fracture along the entire axial length of the pressurized portion of the hole, as will be explained in greater detail hereinafter. Pressurization by explosives is a preferred embodiment because it more readily provides this type of fracture growth.

In the accompanying drawing, which illustrates specific embodiments of the fracturing method of the invention.

DETAILED DESCRIPTION

Figure 1:
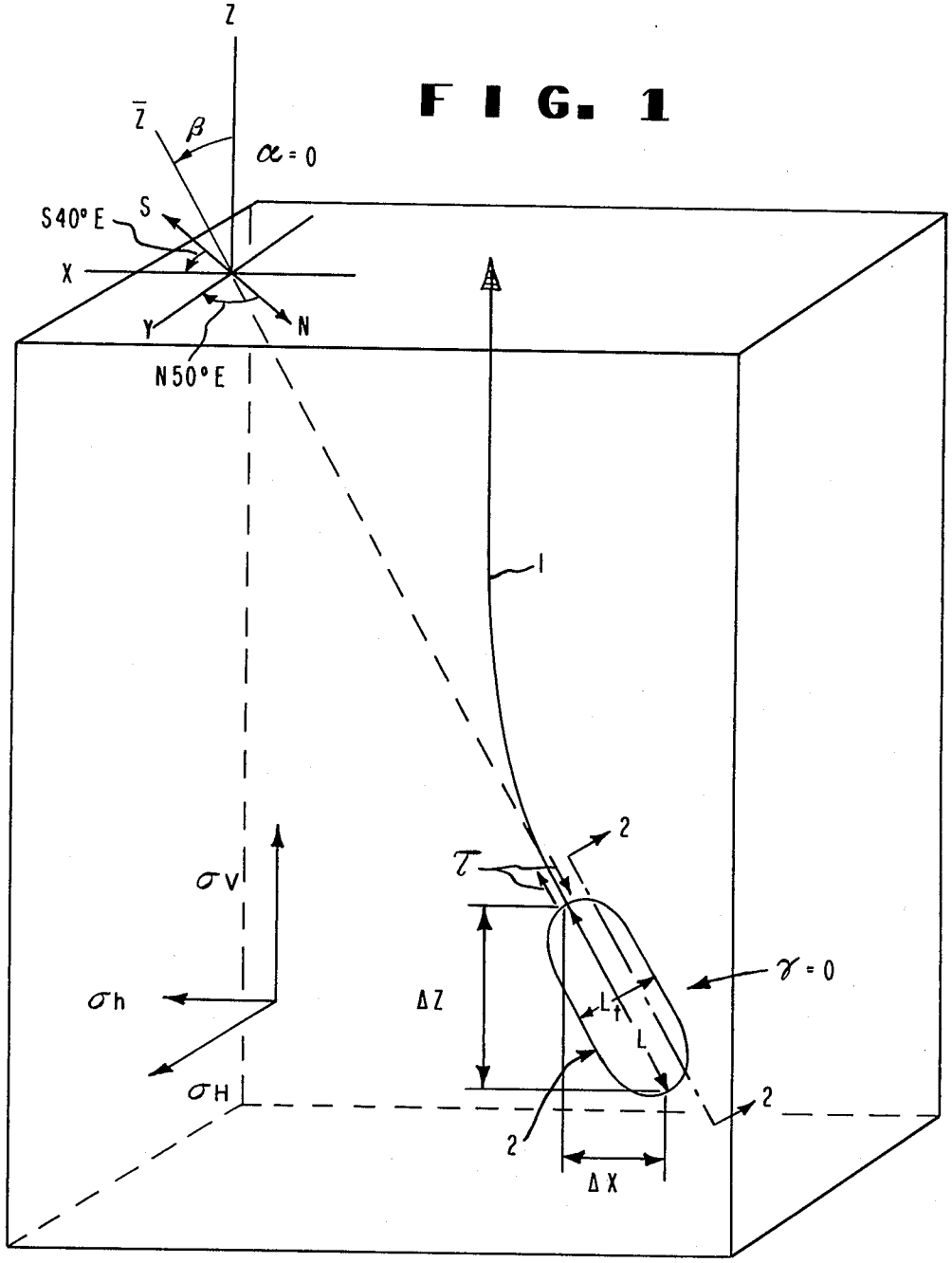
FIG. 1 is a schematic representation of the orientation of a pressurized hole and the resulting fractures with respect to the principal tectonic stress directions in an underground formation in accordance with the method of the invention.

The creation of underground fractures is influenced by the state of stress existing in the underground formation. It is well-known that the stresses in the ground are not isotropic, and, in general, the three principal stresses are different. The term "tectonic stress" is used to describe this underground state of stress. The vertical stress arises from the weight of overlying rock. The principal stresses at depths of typical oil and gas formations are vertical and horizontal, except in regions of very large topographic features on the land surface. In the hydrofracturing treatment a section of a vertical wellbore is isolated by setting packers, and a liquid is pumped into the packed-off section to a pressure high enough to cause the surrounding rock to fracture. Pressurizing a cylindrical hole generates a circumferential or hoop tension. When superimposed on the existing tectonic stress, the hoop tension produces a maximum tension at two diametrically opposed orientations, leading to the formation of a pair of fractures lying in a plane which is perpendicular to the least horizontal principal stress. More fluid is pumped into the well to increase the length of the fracture. Usually the extension takes place at a much lower pressure than the break-down pressure required to initiate the fracture. If the well is shut-in (by closing a valve in the fluid line), the pressure falls quickly to a value where it nearly levels off. The pressure at the onset of the nearly level period is termed the instantaneous shut-in pressure. It is believed to be just equal to the minimum horizontal stress, since any higher pressure holds the faces of the fracture apart. Usually the least horizontal stress is the least compressive principal stress, especially at the depth of most oil and gas formations. Near the surface the least principal stress is usually vertical and the least horizontal stress is the intermediate principal stress. In this situation the fracture often initiates perpendicular to the least horizontal stress and then flips to, and extends along, a horizontal plane perpendicular to the vertical least principal stress. The maximum horizontal stress can be estimated from the breakdown and shut-in pressures and the strength of the rock. Thus in the normal situation at depths where the least principal stress is horizontal, the hydrofracturing treatment provides a method of determining the least principal stress accurately, and the larger horizontal stress approximately. An impression packer can be used to record an impression of the wall of the borehole containing the fracture, and thereby to provide the orientation of the principal stresses. The vertical principal stress can be estimated with good accuracy from the weight of overburden rock. Thus the state of stress at depth can be determined.

Because the fracture produced by hydraulic fracturing is perpendicular to a principal stress, there is no shear displacement between the opposing faces of the fracture. Upon release of the pressure, the fracture closes up and loses its fluid conductivity because the opposing faces fit together. To provide the fluid conductivity needed for gas or oil stimulation, a proppant such as coarse sand must be carried into and allowed to settle in the fracture while it is held open by fluid pressure. Upon removal of the pressure the proppant holds the fracture faces apart and provides a permeable path for the flow of fluid.

The present invention is based on the creation of a fracture in a plane whose normal makes an oblique angle with the principal stress directions. In the present method there is a shear displacement between the opposing fracture faces because the opening of the fracture releases the shear stress that previously existed on the fracture surface. Upon removal of the fluid pressure the opposing faces of the fracture are held apart by misfit between the displaced faces. The degree of misfit is influenced by the magnitude of the shear stress and the length and breadth of the fracture as well as the roughness of the fracture surface, which may be influenced by the rock type and structure. Usually fractures which relieve a shear stress tend to be more irregular than a pure tension fracture. With this type of fracture a proppant is not required to make the fracture conductive. Indeed a fracture held open by misfit may well have a much higher fluid conductivity than a fracture propped by a bed of particles. A fracture with this orientation might be termed a "diagonal fracture." Fracturing methods not suited to transport proppant can be used when the orientation is controlled to give a diagonal fracture. For example the fracturing pressure can be supplied by a detonating explosive.

To determine if it was possible to control the orientation of fracturing and thereby obtain a diagonal fracture, a number of small-scale experiments were carried out in which a small explosive charge in a borehole was detonated in a block of rock held under an anisotropic stress supported by an external frame. As a result of these experiments it was discovered that diagonal fractures could be produced when a relatively long charge was fired in a hole that was slanted with respect to the principal stresses. There appeared to be a strong tendency for the fracture to be constrained to lie in a plane containing the axis of the pressurized portion of the hole. Furthermore, of all such axial planes the fracture tended to form on that plane (the "miniplane") which is under the least compressive normal stress. This plane has been termed the "hypothetical fracture plane". If the normal stress on the hypothetical fracture plane is not too high relative to the minimum principal stress, the tendency of the fracture to lie on the hypothetical fracture plane is very strong. If the normal stress on the hypothetical fracture plane is large compared to the least principal stress, the fracture may not follow the hole axis, but instead flip into a plane normal to the least principal stress. Furthermore, even if the fracture does lie on the hypothetical fracture plane there may be orientations of the hole axis for which the hypothetical fracture plane has no shear stress on it, or very little shear stress.

A schematic drawing showing a typical application of the present invention is shown in FIG. 1. The diagonal fracturing treatment shown is appropriate for stimulating flow from a thick gas-containing formation of Devonian shale, as described in more detail in Example 1. The figure shows a block of rock (e.g., 1200 meters square × 1500 meters deep as in Ex. 1) extending down from the surface of the earth. The principal components of the tectonic stress at formation depth, indicated by $\sigma_h$, $\sigma_H$, and $\sigma_V$ are known either from measurement or interpolation from nearby values, including the orientation of $\sigma_h$ and $\sigma_H$ with respect to the N-S line, as shown by the coordinates on the surface. An initially vertical wellbore 1 is deviated to give a straight portion of length L slanted by an angle $\beta$ from the vertical. The borehole orientation is selected to provide a substantial shear stress $\tau$ on the hypothetical fracture plane, while the normal stress $\sigma_N$ on the hypothetical fracture plane is not much greater than the minimum compressive principal stress ($\sigma_h$ in Example 1). Selection of the orientation is described in detail in Example 1. With this orientation there is a strong tendency for the fracture 2 to be constrained to lie on the hypothetical fracture plane. The portion of the hole of length L is rapidly pressurized with fluid over its entire length, e.g., by filling the length L with explosive, stemming the hole immediately above the explosive, and detonating the explosive. The loading employed produces a diagonal fracture with a transverse fracture length $L_t$. When $L_t$ is less than L, even the extreme edges of the fracture are oriented close to the hypothetical fracture plane, as will be discussed in detail hereinafter. The length of pressurized hole is usually selected to coincide with the interval of depth of formation $\Delta z$ over which flow stimulation is desired.

Figure 2:
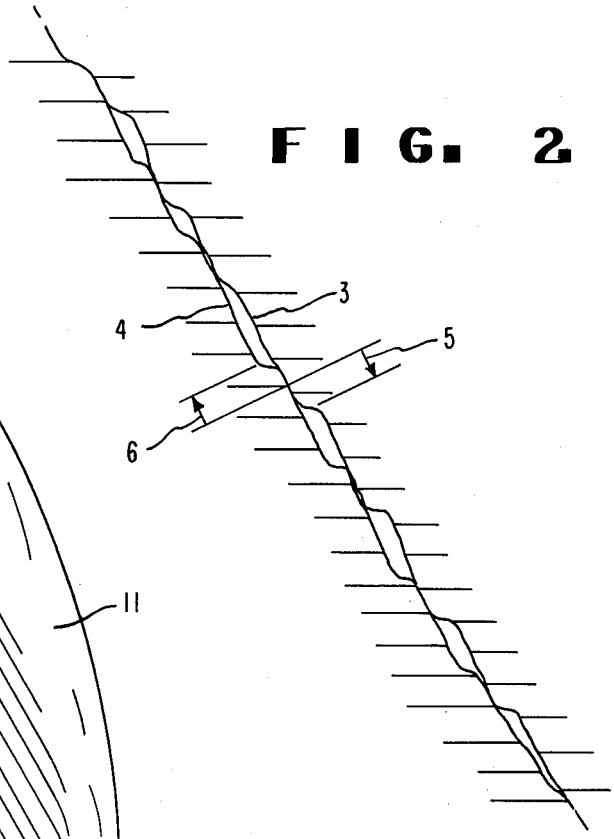
FIG. 2 is a (magnified) schematic cross-section taken through line 2—2 of the fractured zone shown in FIG. 1.

The release of the pre-existing shear stress by the creation of the fracture produces a shear displacement between the opposing fracture faces. The misfit between the displaced faces holds the faces apart, as shown in FIG. 2, which is a schematic enlargement of a longitudinal section of the fracture taken along a line parallel to the axis of the hole shown in FIG. 1. The opposing faces 3 and 4 have been displaced in opposite directions by the displacements 5 and 6, respectively. The misfit is especially effective in producing high conductivity in the direction transverse to the borehole axis because the shear displacement is parallel to the borehole axis, as will be discussed hereinafter. In FIG. 1, $\Delta x$ indicates the horizontal length intercepted by the borehole axis and the diagonal fracture. In some formations, such as the Devonian shale, there are natural fractures with normals making small angles with the direction of $\sigma_h$. Such fractures contribute to the effective permeability of the formation in the vertical ($\sigma_V$) and $\sigma_H$ directions. The interception of a sizable length, $\Delta x$, of these fractures can contribute to the effectiveness of the stimulation obtained by a diagonal fracturing treatment.

In order to select a hole orientation that will give a suitable hypothetical fracture plane, with adequate shear stress and not too high a normal stress, a method is needed for determining the orientation of the axial planes which have extremal (minimum and maximum) values of the normal stress. Having determined the external orientations, the normal and shear stresses on these surfaces need to be computed. Equations are derived below for determining the extremal orientations and the corresponding normal and shear stresses in terms of the orientation of the hole relative to the principal stress directions and the magnitudes of the principal stresses. It has already been noted that the directions and magnitudes of the principal stresses can be determined from hydraulic fracturing experiments and the amount of overburden. Since the principal stresses and their vertical variations do not appear to vary much with changes in horizontal location of many miles, it may often be possible to estimate the principal stresses at the location of interest from measurements made at other locations in the same region. At any rate the principal stress directions and orientations below are assumed to be known.

Figure 4:
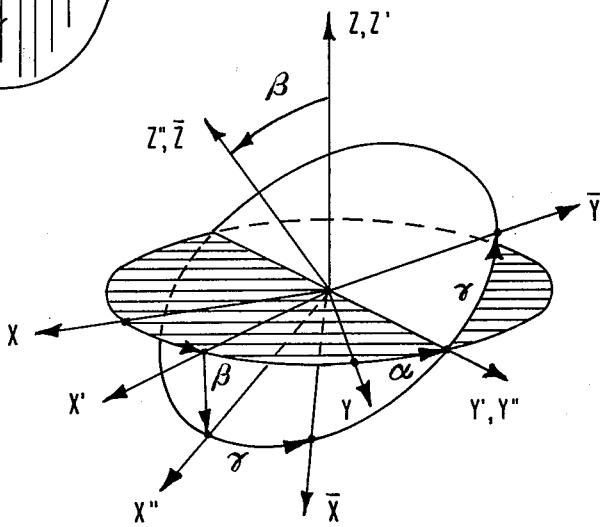
FIG. 4 is a diagram illustrating three successive rotations through the Euler angles $\alpha$, $\beta$, and $\gamma$ used for determining the orientation of, and stresses on, the hypothetical fracture plane.

To determine the orientations for extremal values of the normal stress it is helpful to make use of a rotational transformation of coordinates in terms of the Euler angles $\alpha$, $\beta$, $\gamma$ shown in the diagram of FIG. 4.

First the coordinates x, y, z are aligned, respectively, with the directions of the small compressive horizontal principal stress $\sigma_h$, the larger compressive horizontal principal stress $\sigma_H$, and the vertical principal stress $\sigma_V$. (In the unexpected case where the most nearly vertical principal stress $\sigma_V$ deviates significantly from vertical, the coordinate axis z should be aligned in the direction $\sigma_V$ and not the vertical. In the following discussion $\sigma_V$ and z are assumed to be vertical).

The transformation consists of three rotations in succession of the coordinate system about the origin. The first is a rotation about the z axis by an angle $\alpha$, carrying x to x' and y to y', leaving z unchanged at z'. The second step is a rotation about the y' axis by an angle $\beta$, carrying x' to x'', leaving y' unchanged at y'', and carrying z' to z''. The third step is a rotation about the z'' axis by an angle $\gamma$, carrying x'' to $\bar{x}$, y'' to $\bar{y}$ and leaving z'' unchanged at $\bar{z}$. The axis of the pressurized portion of the borehole is located along the axis $\bar{z}$. It may be noted that the orientation of $\bar{z}$ is determined by two angles, $\alpha$ and $\beta$. The hypothetical fracture plane is a plane that includes the $\bar{z}$ axis. The angle $\gamma$ which defines the orientation of the hypothetical fracture plane around the axis $\bar{z}$ is defined by the criterion that $\gamma$ takes that value for which the stress normal to the fracture plane has a minimum value. The normal to the fracture plane is taken as the $\bar{x}$ direction, so that the normal stress ($\sigma_N$) on the fracture plane is $\overline{T}_{11}$, which is the stress on a surface perpendicular to the $\bar{x}$ axis (indicated by the first subscript index) in the direction of the $\bar{x}$ axis (indicated by the second subscript). The shear stress on the same surface directed along the hole axis $\bar{z}$ is designated $\overline{T}_{13}$, the index 3 indicating the direction of the stress is in the $\bar{z}$ direction. Similarly, $\overline{T}_{12}$ is the shear stress on the same surface in the $\bar{y}$ direction (perpendicular to the axis of the hole).

The matrix of the direction cosines of the transformed coordinates $\bar{x}$, $\bar{y}$, $\bar{z}$ relative to x, y, z is (See Jon Mathews and R. L. Walker, "Mathematical Methods of Physics", W. A. Benjamin, Inc., New York, 1964, pp. 374–378):

$$M = M_{ij} = \begin{pmatrix} \cos\beta\cos\alpha\cos\gamma - \sin\alpha\sin\gamma & \cos\beta\sin\alpha\cos\gamma + \cos\alpha\sin\gamma & -\sin\beta\cos\gamma \\ -\cos\beta\cos\alpha\sin\gamma - \sin\alpha\cos\gamma & -\cos\beta\sin\alpha\sin\gamma + \cos\alpha\cos\gamma & \sin\beta\sin\gamma \\ \sin\beta\cos\alpha & \sin\beta\sin\alpha & \cos\beta \end{pmatrix} \quad (1)$$

The first index indicates the row and the second index the column.

The transformation matrix M can be used to transform vectors and tensors expressed in the untransformed coordinate system xyz into vectors and tensors expressed in the transformed coordinates. The transformation rule for vectors is $$\overline{A}_j = \sum_i M_{ji} A_i \quad (2)$$

where $A_i$ and $\overline{A}_j$ are column vectors in matrix notation.

$$A_i = \begin{pmatrix} A_1 \\ A_2 \\ A_3 \end{pmatrix} \tag{3}$$

where the indices 1, 2, 3, refer to components along the x, y, z axis.

The transformation rule for a tensor (such as stress) is $$\overline{T}_{ij} = \sum_{kl} M_{ik} M_{jl} T_{kl} \tag{4}$$

where $T_{kl}$ is the stress tensor in the untransformed coordinate system x, y, z, where the first index indicates the row and the second the column in matrix notation, and in the tensors where the first index specifies the direction of the normal to the surface and the second index the direction of the stress. Noting that the xyz coordinates have been aligned with the principal stress directions:

$$T_{kl} = \begin{pmatrix} \sigma_h & O & O \\ O & \sigma_H & O \\ O & O & \sigma_V \end{pmatrix} \tag{5}$$

The normal stress $\sigma_N$ on the hypothetical fracture plane is then $$\sigma_N = \overline{T}_{11} = \sum_{kl} M_{1k} M_{1l} T_{kl} \tag{6}$$

$$= M_{11}M_{11}T_{11} + M_{12}M_{12}T_{22} + M_{13}M_{13}T_{33}$$

$$\begin{aligned} \sigma_N = {} & (\cos\beta\cos\alpha\cos\gamma - \sin\alpha\sin\gamma)^2\sigma_h \\ & + (\cos\beta\sin\alpha\cos\gamma + \cos\alpha\sin\gamma)^2\sigma_H \\ & + \sin^2\beta\cos^2\gamma\sigma_V \end{aligned} \tag{7}$$

To determine the values of $\gamma$ where $\sigma_N$ is either a maximum or minimum, we set $$\frac{d\sigma_N}{d_\gamma} = O \tag{8}$$

$$\begin{aligned} \tfrac{1}{2}\frac{d\sigma_N}{d_\gamma} = O = {} & (\cos\beta\cos\alpha\cos\gamma - \sin\alpha\sin\gamma) \\ & (-\cos\beta\cos\alpha\sin\gamma - \sin\alpha\cos\gamma)\sigma_h \\ & + (\cos\beta\sin\alpha\cos\gamma + \cos\alpha\sin\gamma)(-\cos\beta\sin\alpha\sin\gamma + \cos\alpha\cos\gamma)\sigma_H \\ & -\sin^2\beta\cos\gamma\sin\gamma\sigma_V \\ & [-\cos^2\beta\cos^2\alpha\sin\gamma\cos\gamma + \cos\beta\sin\alpha\cos\alpha\sin^2\gamma - \\ & \qquad \cos\beta\sin\alpha\cos\alpha\cos^2\gamma + \sin^2\alpha\sin\gamma\cos\gamma]\sigma_h \\ & + \\ & [-\cos^2\beta\sin^2\alpha\sin\gamma\cos\gamma - \cos\beta\sin\alpha\cos\alpha\sin^2\gamma + \\ & \qquad \cos\beta\sin\alpha\cos\alpha\cos^2\gamma + \cos^2\alpha\sin\gamma\cos\gamma]\sigma_H \\ & - \\ & \sin^2\beta\sin\gamma\cos\gamma\sigma_V = O \\ & (\sin\gamma\cos\gamma)\,[-\cos^2\beta\cos^2\alpha + \sin^2\alpha)\sigma_h + (-\cos^2\beta\sin^2\alpha + \\ & \qquad \cos^2\alpha)\sigma_H - \sin^2\beta\sigma_V] \\ & +\sin^2\gamma\,[(\cos\beta\sin\alpha\cos\alpha)\sigma_h - (\cos\beta\sin\alpha\cos\alpha)\sigma_H] \\ & -\cos^2\gamma\,[(\cos\beta\sin\alpha\cos\alpha)\sigma_h - (\cos\beta\sin\alpha\cos\alpha)\sigma_H] = O \end{aligned}$$

Noting that $2\sin x\cos x = \sin 2x$ and $\cos^2 x - \sin^2 x = \cos 2x$ $$\tan 2\gamma = \frac{\sin 2\gamma}{\cos 2\gamma} = \frac{\sin 2\alpha\cos\beta\,(\sigma_H - \sigma_h)}{(\cos^2\beta\cos^2\alpha - \sin^2\alpha)\sigma_h + (\cos^2\beta\sin^2\alpha - \cos^2\alpha)\sigma_H + \sin^2\beta\sigma_V} \tag{9}$$

Note that if $\gamma_1$ specifies one extreme value of $\sigma_N$, then $\gamma_2$ specifies another, where $$2\gamma_2 = 180° + 2\gamma_1,$$

or $$\gamma_2 = 90° + \gamma_1 \tag{10}$$

It may be of interest to determine what value of $\gamma(=\gamma_{H=0})$ specifies a plane that has no $\sigma_H$ component to $\sigma_N$.

Noting that $\cos\beta\sin\alpha\cos\gamma + \cos\alpha\sin\gamma = 0$ $$\tan\gamma_{H=0} = -\cos\beta\tan\alpha \tag{11}$$

Also the value of $\gamma(=\gamma_{V=0})$ for which there is no $\sigma_V$ component to $\sigma_N$ can be obtained from $$\sin^2\beta\cos^2\gamma = 0$$

$$\gamma_{V=0} = 90° \tag{12}$$

It is also noted that when $\alpha = 0$, the extremal values of $\gamma$ that make $\sigma_N$ minimum and maximum are $$\gamma_1 = 0 \text{ and } \gamma_2 = 90° \tag{13}$$

Having determined the extremal values $\gamma_1$ and $\gamma_2$ from equations (9) and (10), these values of $\gamma$ can in turn be substituted in equation (7) to obtain two values of $\sigma_N$, one of which is a minimum, one a maximum for all possible angles $\gamma$. The minimum value is designated $\sigma_{N1}$ with the orientation $\gamma_1$ defining the hypothetical fracture plane.

Equations to evaluate the shear stress on the hypothetical fracture plane are also needed. The shear stress component directed in the direction perpendicular to the axis of the hole is given by $$\tau_{\bar{x}\bar{y}} = \overline{T}_{12} = \sum_{kl} M_{1k} M_{2l} T_{kl} \tag{14}$$

$$\text{where } T_{kl} = \begin{pmatrix} \sigma_h & O & O \\ O & \sigma_H & O \\ O & O & \sigma_V \end{pmatrix}$$

$$\begin{aligned} & = M_{11}\,M_{21}\,T_{11} + M_{12}\,M_{22}\,T_{22} + M_{13}\,M_{23}\,T_{33} \\ & = -(\cos\beta\cos\alpha\cos\gamma - \sin\alpha\sin\gamma) \\ & \qquad (\cos\gamma\cos\alpha\sin\gamma + \sin\alpha\cos\gamma)\sigma_h \\ & \quad +(\cos\beta\sin\alpha\cos\gamma + \cos\alpha\sin\gamma) \\ & \qquad (-\cos\beta\sin\alpha\sin\gamma + \cos\alpha\cos\gamma)\sigma_H \\ & \quad -\sin^2\beta\sin\gamma\cos\gamma\sigma_V \end{aligned}$$

The shear stress component in the axial direction is $\tau_{\overline{xz}}$ $$\begin{aligned} \tau_{\overline{xz}} = \overline{T}_{13} & = M_{11}M_{31}\sigma_h + M_{12}M_{32}\,\sigma_H + M_{13}M_{33}\,\sigma_V \\ & = (\cos\beta\cos\alpha\cos\gamma - \sin\alpha\sin\gamma)\,(\sin\beta\cos\alpha)\sigma_h \\ & \quad +(\cos\beta\sin\alpha\cos\gamma + \cos\alpha\sin\gamma)\,(\sin\beta\sin\alpha)\sigma_H \\ & \quad -(\sin\beta\cos\beta\cos\gamma)\sigma_V \end{aligned} \tag{15}$$

When $\sigma_N$ is either a maximum or minimum value the transverse shear stress $\tau_{\overline{xy}}$ is exactly zero, and the total shear stress on the hypothetical fracture plane is $\tau_{\overline{xz}}$, directed in the axial direction. If one were interested in determining the shear stress for other values of $\gamma$, its magnitude and direction are given by equations (16) and (17)

$$\tau = [\tau_{\bar{x}\bar{y}}^2 + \tau_{\bar{x}\bar{z}}^2]^{\frac{1}{2}} \tag{16}$$

making an angle $\sigma$ with the hole axis ($\bar{z}$), where $$\tan\sigma = \tau_{\overline{xy}}/\tau_{\overline{xz}} \tag{17}$$

The transformation M can also be used to determine the length of pressurized hole L that intersects a formation vertical depth interval $\Delta z$. Horizontal components $\Delta x$, $\Delta y$ and $\Delta W=[(\Delta x)^2+(\Delta y)^2]^{\frac{1}{2}}$ can also be obtained. If the pressurized length of hole is represented by $$\overline{A}=\begin{pmatrix}O\\O\\L\end{pmatrix}$$

The components in the untransformed coordinates are $$\Delta x=A_1=M_{31}L=L\sin\beta\cos\alpha \quad (18)$$

$$\Delta y=A_2=M_{32}L=L\sin\beta\sin\alpha \quad (19)$$

$$\Delta z=A_3=M_{33}L=L\cos\beta \quad (20)$$

$$\Delta W=L\sin\beta=\Delta z\tan\beta \quad (21)$$

The foregoing mathematical discussion is useful in the selection of a suitable orientation of the borehole axis to be used in a fracturing treatment. First the principal stresses must be estimated either by hydraulic fracturing methods (as discussed by B. C. Haimson, Symp. Soc. Internat. des Roches, Nancy, 1971, Vol. II, Paper No. 30), or by extrapolation or interpolation from previous measurements in the region. A number of pairs of values of $\alpha$ and $\beta$ can be selected and the values $\gamma_1$, $\gamma_2$, $\sigma_N$ and $\tau$ for each hypothetical fracture plane can be computed from Equations 9, 10, 7, and 15. From the computed values a suitable orientation defined by $\alpha$ and $\beta$ can be chosen to provide a substantial shear stress and a relatively low normal stress. This method is illustrated in Example 1. The small-scale experiments (Examples 2–3) which were done to study fracture orientation under anisotropic stress provide information which can be used to guide the selection of hole orientation and loading conditions in a full-scale fracturing treatment. Further small-scale experiments could be done to investigate different anisotropic stress situations. The usefulness of the information obtained on the small scale depends on how well the behavior scales to the prototype. It is believed that the small-scale experiments simulate approximately what would happen on a large scale with all three space coordinates and time scaled by the same scale factor (e.g., a scale factor of 700). Systems that scale in this way are said to obey dynamical similarity. Pressures and velocities are unchanged, but accelerations are scaled inversely. Gravity was not properly scaled in the small-scale experiments, but it is not believed that gravity plays an important role in an explosive treatment if the thickness of the formation being treated is less than its depth. In the small-scale experiments the stresses along the pressurized hole were uniform, whereas in the full-scale formation there will be some variation of stress with depth. Phenomena that depend on gradients, such as heat conduction and (laminar) viscous flow do not obey dynamical similarity. In the explosive treatment most of the gas flow along the fractures is turbulent, and turbulent flow does scale according to dynamical similarity. Although the deviations from linear scaling are not believed to be large, such deviations would tend to reduce the scaled extent of fracturing in the small-scale experiments relative to full-scale behavior. The small-scale experiments can be expected to predict a minimum extent of fracturing on a large scale, with a possibility that the extent of fracturing actually obtained on a large scale may be in the range of 1 to 2 times the predicted value.

Figure 3:
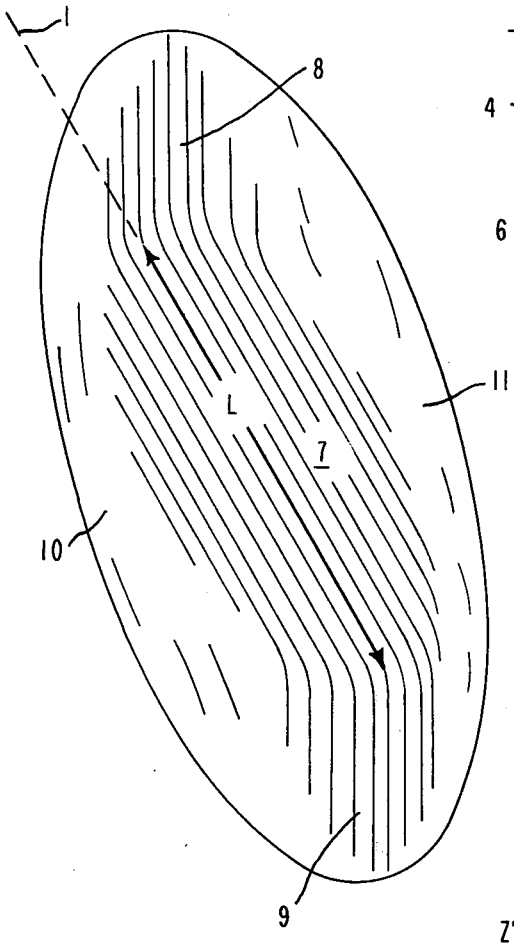
FIG. 3 is a schematic representation of the fracturing obtained when the pressurized portion of a hole is shorter than the transverse dimension of the fracture.

It has already been noted that it is desirable to have a high shear stress on the hypothetical fracture plane because a higher shear stress produces a larger shear displacement between the fracture faces, which will usually provide a greater average width and therefore a more conductive fracture. However, in the search for a high shear stress, an orientation with too high a normal stress on the hypothetical fracture plane must be avoided for two reasons. Since the fracture is extended only when the fluid pressure exceeds the normal stress on the fracture plane, the extent of fracturing will be decreased somewhat by an increased normal stress. More important is the possibility that the fracture will not grow on the hypothetical fracture plane, but will twist away from the direction of the hole axis and become normal to the minimum principal stress; in that case much of the fracture will be nonconductive. The small-scale experiments showed that the tendency for the fracture to twist out of the desired hypothetical fracture plane was increased when the pressurized portion of the hole was not long enough relative to the transverse length of the fracture. Generally it is advisable to have the length of the pressurized portion of the hole greater than half the transverse length of the fracture, and preferably the pressurized length should be at least equal to the transverse fraction length, especially when the normal stress on the hypothetical fracture plane is considerably higher than the minimum principal stress. If the length of the pressurized portion of the hole is less than the transverse length of the fracture and the normal stress on the hypothetical fracture plane is not excessive, the fracture produced will be fully diagonal near the borehole but will become less diagonal or non-diagonal farther from the pressurized portion. FIG. 3 shows the fracture configuration for such a situation with $\alpha=0$. There is a roughly circular region 7 with diameter equal to the pressurized hole length in which the fracture lies close to the hypothetical fracture plane. The regions 8 and 9 beyond the ends of the pressurized portion of the hole are essentially non-diagonal, and would have very little conductivity. The regions 10 and 11 transversely distant from the pressurized portion of the borehole are less diagonal than the central region and would have reduced conductivity. Thus the result from inadequate pressurized length is not complete failure but rather a decrease in the efficiency of the process. For a given pressurized length any excess explosive load or volume of pressurizing fluid beyond that required to produce a fracture diameter equal to the pressurized length adds very little conductive fracture.

In a full-scale fracturing treatment the specification of an adequate pressurizing length for a given explosive load depends on the prediction of the transverse fracture length that will be obtained. Such a prediction of transverse fracture length may also be useful for estimating the potential benefit (e.g., improvement in gas flow from a gas well) that may be obtained from the treatment. At present it is difficult and costly to determine the fracture boundaries obtained in a deep underground fracturing treatment. In some cases, fracture dimensions can be inferred from observations on the stimulated flow. Currently techniques are being sought to locate underground fractures with less cost. Until some field experience in diagonal fracturing has been developed, guidance can be obtained from small-scale experiments. As already noted it is recommended that a factor of 1 to 2 be allowed in full-scale transverse fracture length to compensate for scale-up error in predicting a full-scale result from small-scale experiments. It is also often necessary to compensate for a higher normal stress on the hypothetical fracture plane in the full-scale treatment compared to the small scale experiment.

Because of the extremely high stress concentration at the tip of a long fracture in brittle material like rock, it is likely that the fracture will continue to extend as long as the average fluid pressure in the fracture exceeds the stress normal to the fractures, the strength of the rock being negligible because of the stress concentration. The same extent of fracturing should be obtained at two different values of the normal stress when the volumes of pressuring fluid (e.g., detonation product gases) are the same at pressures equal to the normal stresses. The relation between volume and pressure depends on whether the expansion is adiabatic on the one extreme or isothermal on the other extreme. The ratio of explosive loads $W_1/W_2$ required to provide the same volume of gas at pressures $P_1$ and $P_2$ is $W_1/W_2=(P_1/P_2)^{1/\gamma}$ in the adiabatic case and $W_1/W_2=P_1/P_2$ in the isothermal case. Since $\gamma$ is usually in a range of 1.2 to 1.3 for explosive product gases, the difference in loads required to compensate for moderate changes in pressure (e.g., a factor of 2 or 3) predicted in the two cases is not large. Since most of the fluid travels along the fractures before the fractures attain maximum size, considerable cooling of the explosive product gases must occur, and the isothermal assumption is probably more appropriate than the adiabatic assumption. The assumption that the gases are cooled can also be used to estimate the effect of substituting a different explosive. The explosive is characterized by n, the number of moles of permanent gas produced per kilogram of explosive. Based on the transverse fracture length, $L_t$, obtained in the small-scale experiment described in Example 2, and assuming that the fracture shape (length/average width) is the same as the instant when maximum fracture extension is obtained, an explicit formula can be obtained which can be used as a rough guide to predict transverse fracture length for a given explosive loading W/L, where W is the mass of explosive and L the length of the charge. The area of the transverse section of the fracture A at the instant when maximum fracture extension is attained is equated to the volume of explosive product gas V per unit length of charge at the temperature T (K) of the rock and a pressure P (MPa) equal to the normal stress on the hypothetical fracture plane.

$$A = \frac{V}{L} = n\frac{W}{L}\ \frac{T}{P} \times 8.314 \times 10^{-6}$$

From the small-scale experiment it was found that $$L_t = 100A^{\frac{1}{2}} \tag{22}$$

A range factor of 1–2 is included for a likely error in scaling up to full scale from the small-scale experiments.

$$L_t = (1\text{–}2)\ (0.288)\left(\frac{n\,W\,T}{L\,P}\right)^{\frac{1}{2}}$$

or, rounding off, $$L_t = (0.3\text{–}0.6)\left(\frac{n\,W\,T}{L\,P}\right)^{\frac{1}{2}} \tag{23}$$

In the small-scale experiment described in Example 2, the cross-sectional area of the hole was much larger than that of the explosive because it was not possible to drill a hole of the required length with a diameter less than 1.6 mm compared to the charge diameter of 0.66 mm. The cross-sectional area of the hole was subtracted from the volume of gas per unit length to obtain the fracture volume. In full-scale treatments there usually will be little excess hole volume, and furthermore the explosion product gases in the borehole will not be cooled much; thus the hole volume can be neglected in large-scale explosive treatments.

In cases where the length of the pressurized portion of the hole is more than adequate, there is still a limit to the normal stress on the hypothetical fracture plane $\sigma_{N1}$ beyond which the fracture will not be constrained to lie on an axial plane. Beyond this limit the fractures may be initiated as axial fractures, but as radial extension proceeds the fractures may break up into a number of narrow ribbons which quickly twist into an orientation perpendicular to the least compressive principal stress. To ensure an axial fracture the hole orientation should be chosen to make $\sigma_{N1}$ less than the mean stress $\sigma_m$ ($\sigma_m=(\sigma_h+\sigma_H+\sigma_V)/3$), and preferably to make $\sigma_{N1}$ closer to the minimum compressive principal stress than to the $\sigma_m$. Since the highest shear stresses exist on surfaces on which the normal stress is near $\sigma_m$, a relatively high shear stress can be obtained with a normal stress less than $\sigma_m$. In the case where the hole axis is oblique to two principal stresses (e.g., for $\alpha=0$, in which case $\gamma_1=0$), the maximum shear stress is obtained for $\beta=45°$, in which case $\sigma_N$ is the average of the two principal stresses. When $\beta=30°$, the shear stress reaches 86.6% of its maximum value, whereas the normal stress $\sigma_N$ is only at the 25% level of the interval between the two principal stresses compared to the 50% level at $\beta=45°$. The small difference in shear stress may have little effect on the fracture conductivity, while the decrease in $\sigma_N$ at 30° from that at 45° will not only provide more certain control of the fracture orientation but will provide a greater extent of fracturing. As a general rule, a better result will be obtained by selecting an orientation that provides slightly less than maximum shear stress with lower normal stress on the hypothetical fracture plane. In a field treatment other factors will need to be taken into consideration, such as the cost of drilling to the orientation selected, ease of loading in an explosive treatment, desirability of intercepting an interval of natural horizontal fractures, etc.

No explicit minimum value of shear stress on the hypothetical fracture plane can be specified. At low values of the shear stress the conductivity of the fracture will be decreased, and for any application there will be an economic limit. There are also lower limits to the differences between principal stresses that produce fracture-orienting effects. In small-scale hydrofracturing experiments in blocks under two different horizontal principal stresses with vertical holes, orientation of the fracture required differences of 0.5–1.5 MPa between the principal stresses. The orientation effects of the method of this invention depend on the least compressive principal stress being distinctly less than the intermediate principal stress. (The situation where the two larger principal stresses are equal presents no problem as long as the least principal stress is substantially lower). Measurements at a number of locations in North America indicate that the vertical and least horizontal stresses ($\sigma_V$ and $\sigma_h$) are equal at a depth that varies from about 200 m to about 700 m. If $\sigma_V$ and $\sigma_h$ are only slightly different, the problem is as follows. If the hole axis is made horizontal, there is a strong orienting effect on $\gamma$, but the shear stress on the hypothetical fracture plane is very low. On the other hand, if the hole axis is slightly off vertical, a moderate shear stress can be obtained on the hypothetical fracture plane, but the orienting effect on $\gamma$ is very slight. It is found that the difference between the maximum normal stress $\sigma_{N2}$ at $\gamma_2=\gamma_1+90°$ and the minimum normal stress $\sigma_{N1}$ at $\gamma_1$ for all axial planes is very small. Furthermore, for $\alpha=0$, the shear stress on the surface with $\gamma=\gamma_2$ is zero. Because of the stress differences required for orientation, the difference between $\sigma_{N2}$ and $\sigma_{N1}$ must be at least 0.5 MPa and preferably at least 1.5 MPa. Also if $\beta$ is made too large, with $\alpha=0$, it is found that there is no shear stress on the surface with minimum $\sigma_N$, but there is shear stress on the surface with maximum $\sigma_N$. Other cases in which $\alpha$ is varied can be evaluated by the appropriate stress equations; it will be found that no combination of adequate shear stress and adequate orienting stress difference on $\gamma$ can be obtained when $\sigma_V$ and $\sigma_h$ are close together. In practice, in evaluating whether the difference in $\sigma_V$ and $\sigma_h$ in a specific application is adequate, the probability of a poor result from errors in the measured or estimated stresses should be considered.

The small-scale experiments demonstrated that a detonating explosive charge is an effective means for supplying fluid under pressure to produce an extensive diagonal fracture. The explosive detonation almost instantaneously supplies fluid under extremely high pressure, and thus strongly overdrives the fracturing process. The overdrive causes the major fracture, on the hypothetical fracture plane, to grow in a radial direction uniformly along the entire length of the loaded portion of the borehole. The uniform fracture growth accounts for the strong orientation effect of the slanted hole in forcing the fracture to form on an axial plane. The potential effectiveness of alternative methods of supplying pressurizing fluid can be assessed on the basis of whether they provide enough overdrive to give uniform fracture growth along the whole length of the pressurized portion of the borehole.

Stimulation of vertical oil and gas wells by detonating explosives in the well bore was widely practiced in the past and is currently practiced in some special formations. The stimulating effect results from the formation of a highly fractured cylindrical zone around the well bore. There is sufficient deformation and misalignment of blocks defined by fractures to provide a fractured zone of relatively high effective permeability. The growth of the highly fractured zone stops when the pressure of the explosion product gases falls below the level required to pressurize the boundary of the fractured zone to the rock failure point. However, at this time the gas pressure is high enough to extend individual fractures by flowing into the fractures and developing high stress concentrations at the fracture tips. The anisotropic stress in the ground favors the growth of the fractures perpendicular to the least principal stress. Thus a pair of large fractures perpendicular to the least principal stress is formed, much like the fracture pair formed in hydrofracturing. However, after the explosion subsides, the two large fractures close up again and are ineffective in stimulating fluid flow from the formation.

In the explosive treatment of slanted holes in the practice of the present invention, there will be formed a roughly cylindrical zone of highly fractured rock which will have a high effective permeability, and therefore will contribute to the effectiveness of the stimulation. The much more extensive pair of fractures produced by gas flow into the growing fractures will be diagonal and conductive. Because of the much greater transverse length of the pair of large diagonal fractures compared to the diameter of the highly fractured zone, the large diagonal fractures will make a major contribution to the overall flow improvement. To obtain the maximum transverse fracture length, it is necessary to provide adequate stemming in the borehole above the explosive charge to prevent the escape of explosion product gases until after the fractures have attained maximum extension. The stemming requirement is more important and more stringent than in conventional explosive treatment of vertical holes because the growth of the large diagonal fractures proceeds to a much lower pressure, taking a longer time, than does the growth of the highly fractured cylindrical zone. However, it is not necessary for the stemming to remain fixed, as long as it is sufficiently massive and has low enough compressibility to minimize escape of gas until after the fractures have reached full extension.

Figure 5:
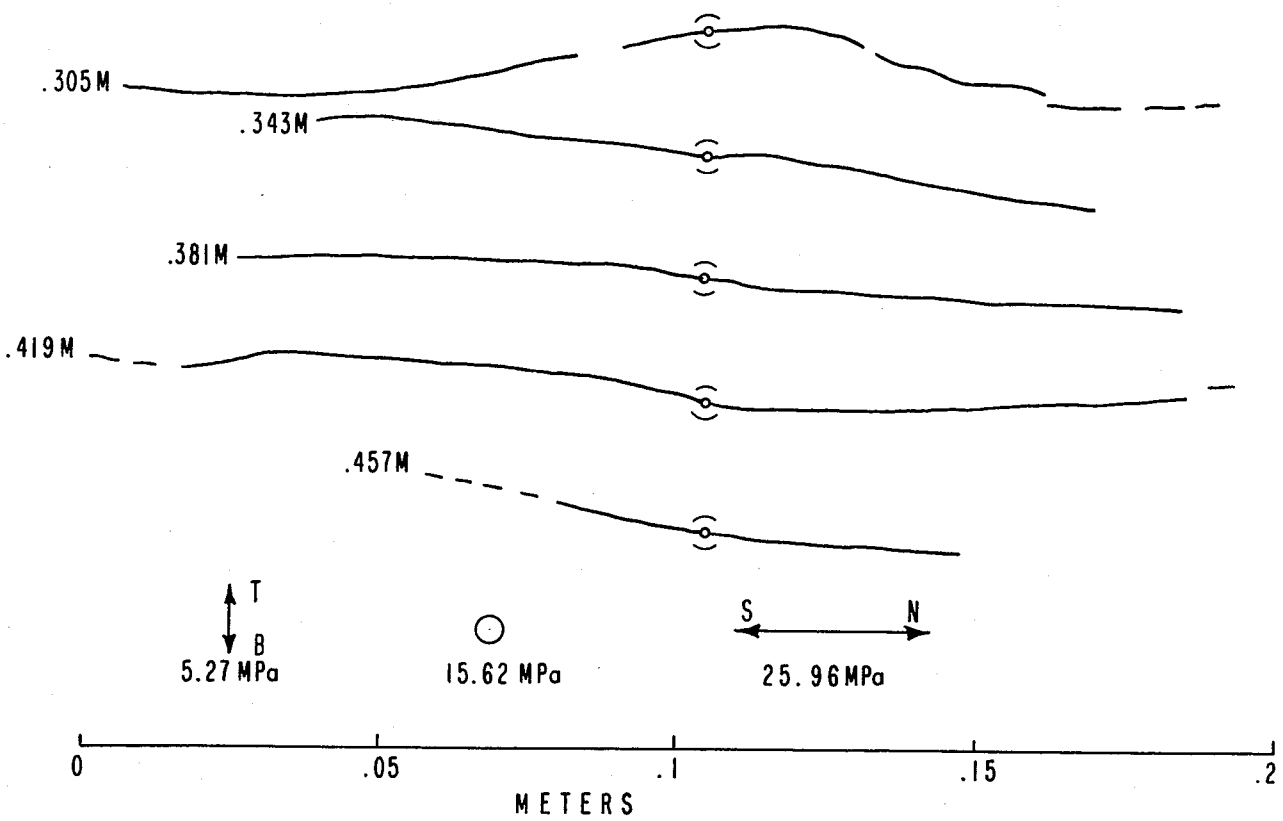
FIG. 5 is a tracing of a fracture produced as described in Example 2.

As in conventional explosive stimulations it will often be worthwhile to clean out stemming and debris in the borehole after the shot. Quite often large fragments intruding into the shot borehole prevent entry into much of the borehole. As has been found in conventional explosive stimulation, this is not a problem because the highly fractured zone has a high effective permeability and allows adequate flow in the axial direction. If in a formation there appeared to be blockage of flow by debris, the amount of debris could be reduced by decoupling of the explosive, which could be accomplished by underreaming the loaded portion of the hole to provide additional volume around the explosive held in a containing tube. The effect of decoupling is illustrated by the small-scale experiments described in Examples 2–3. In those experiments it was not possible to drill a long bore hole with nearly as small a diameter as the extruded plastic explosive. The highly decoupled explosion produced only a few very short random fractures around the borehole and two very extensive fractures lying approximately in the hypothetical fracture plane, as shown in FIG. 5.

Alternative methods of supplying pressurizing fluid must provide sufficient overdrive to give uniform fracture growth along the pressurized length of the borehole. Deflagrating explosives or propellants burn rapidly and can generate very high pressures when confined and are capable of providing an adequate supply of fluid at high pressure to give uniform fracture growth. They would produce a relatively clean fracture with little debris in the borehole.

In specialized situations it may be useful to provide a pressurizing means above the zone to be fractured. For example, in the recovery of geothermal energy, to provide a conductive fracture between two boreholes to allow the inflow of cold water into contact with a large area of hot dry rock and the outflow of hot water, two slanted holes could be drilled for pressurization to produce intersecting diagonal fractures. Because of the high temperature of the rock, an explosive loaded directly into the boreholes would decompose or be detonated prematurely by the high temperature. A long borehole is also difficult to cool. A chamber of much larger diameter could be reamed out just above the length of each hole to be pressurized. Because of their smaller surface areas, these chambers could be cooled and/or insulated, then filled quickly with explosives, stemmed, and shot. The explosion product gases travelling down the narrow boreholes would provide adequate pressurizing fluid pressure to give intersecting diagonal fractures.

In the conventional hydrofracturing process in which non-diagonal fractures are formed perpendicular to the least compressive principal stress, pressurization is obtained by mechanically pumping in a liquid under high pressure. Over a period of time (e.g., a few hours), a substantial volume of liquid can be pumped into the fractures. The main problems result from the high viscosity required to suspend the proppant and prevent the leak-off of liquid into the rocks. The leak-off limits the length of time over which the process can be run, and together with the viscosity requires a high pumping power. With respect to the use of mechanical pumping of a liquid to accomplish diagonal fracturing from a slanted hole, the problems have a different origin, viz., the need to achieve fracture initiation and uniform fracture growth along the entire length of the pressurized portion of the hole. Leak-off will still place a limit on the duration of the treatment. Suspension of proppant is not involved, but high viscosity may be required to control hole pressure in relation to liquid flow rate. Because of the requirement in diagonal fracturing of a length of pressurized hole at least half the transverse length of the diagonal fracture, application of diagonal fracturing will often be made to relatively thick formations, and the pumping power and flow rate requirements will be increased. The variation of principal stresses with depth is substantial, and generally exceeds the variation of hydrostatic head with depth for common liquids such as oil or water by about a factor of 2. Thus there will be a tendency for fractures to initiate and to grow at the top of the pressurized portion of the hole. It is usually the case, depending on the stresses and the strength of the rock, that the pressure $P_B$ required to break down the formation by initiating radial fractures is considerably higher than the pressure required to propagate long fractures, which is only slightly higher than the normal stress on the fracture plane. Furthermore, there are usually preexisting fractures and joints that intersect the borehole, which are capable of being opened up by pressures much lower than the breakdown pressure. If fracturing were initiated in a localized region, the fracture would tend to grow, diverting fluid that otherwise would have increased the borehole pressure to give further initiation of fracturing along the hole. The growing localized fracture would not be constrained to grow in an axial plane and would twist into a non-diagonal orientation perpendicular to the least compressive principal stress. Growth of localized fractures could be slowed down by increasing the viscosity of the liquid. By a selection of a viscosity and pumping capacity to develop a borehole pressure exceeding the maximum value of $P_B$ at the bottom of the pressurized portion while minimizing growth of local fractures, fractures can be initiated along the entire length of the pressurized portion of the hole. During the fracture growth stage the borehole pressure needs to be maintained enough above the fracture-propagating stress at the bottom of the hole to give uniform growth of the fractures. In this stage leak-off into the rock facing the fractures limits the useful duration of pumping.

Because the breakdown pressure depends on the effective tensile strength of the rock, the breakdown pressure may not be known accurately in those cases where the tectonic stress is being interpolated from neighboring values. A measured record of rising borehole pressure versus time during the pressurization will show a distinct decrease in slope as breakdown begins. The variation of breakdown pressure along the pressurized length, $\Delta P_B$, neglecting any variation in tensile strength, is given by $\Delta P_B = \Delta(3\sigma_{N1} - \sigma_{N2})$ where $\Delta$ is the total variation along the pressurized length. The rate of supply of pressurizing fluid should be sufficient to cause the hole pressure to exceed this pressure at which the slope decreases by at least $\Delta P_B$, and preferably by more than $\Delta P_B$.

When using a pressurizing method other than an explosion, the volume of fluid required to achieve a specified transverse fracture length can be estimated roughly from Equation 22, modified by putting in a scale-up factor of 2, i.e., $L_t = 200\ A^{\frac{1}{2}}$, where A is the volume of fluid injected into the fracture per unit length of hole. In conventional hydrofracturing, it is thought that the created fracture length is greater than this estimate, that is, the fracture has a higher length/average width; but much of this length is not propped. On the other hand, the overdriving required to provide the uniform growth required to produce a diagonal fracture would tend to reduce the length/width toward that observed for the explosive treatment. Also an allowance must be made for loss of fluid into the rock facing the fractures.

Because of the requirement that the length of the pressurized portion of the hole be commensurate with the transverse fracture length, to control the fracture orientation, together with the fact that excessive hole volume depletes the volume of explosive gases available to flow into and pressurize the fracture, the pressurized portion of the hole must have a high length-to-diameter ratio. Furthermore, the high cost of drilling holes deep into the ground makes it uneconomical to use a larger diameter than is required for introducing or withdrawing fluids. For any suitable method of supplying the fluid under pressure required for diagonal fracturing, the length-to-diameter ratio of the hole must be large, i.e., at least 50, and preferably at least about 100.

The following examples illustrate specific embodiments of the method of the invention.

EXAMPLE 1

The object is to stimulate the flow of natural gas from a 305-meter-thick section of Devonian shale at a depth of 1067 to 1372 meters at a location in West Virginia. Measurements of the tectonic stress in the region indicate that the principal stresses are vertical and horizontal and that at a depth of 1219 meters the vertical stress $\sigma_V$ is 31.71 MPa, the larger horizontal stress $\sigma_H$ is 48.26 MPa, and the smaller horizontal stress $\sigma_h$ is 24.13 MPa. Furthermore, the direction of $\sigma_H$ is N 50° E. The measurements also indicate that at depths of 1067 meters and 1372 meters the stress values were $\sigma_H = 44.29$ and 52.22 MPa, $\sigma_h = 22.06$ and 26.20 MPa and $\sigma_V = 27.75$ and 35.68 MPa. A single slanted hole is to be pressurized by the detonation of an aluminized water gel explosive to produce a diagonal fracture.

First it is necessary to select a suitable orientation of the hole which will meet the requirements that the value of the normal stress $\sigma_N$ on the hypothetical fracture plane not be too much greater than $\sigma_h$, and that the shear stress $\tau$ on the hypothetical fracture plane be large enough to provide shear displacement between the faces of the fracture to hold the fracture open to provide adequate conductivity for gas flow. To aid in making a proper selection, Equations 9, 10, 7 and 15 are used to calculate $\sigma_N$ and $\tau_a$ ($=\tau_{\overline{xz}}$) for several trial orientations of the hole. First the coordinate system x, y, z, must be oriented so that z is vertical, y is directed N 50° E, and x is directed S 40° E. Trial values of $\alpha$ and $\beta$ together with values of $\gamma_1$, $\gamma_2$, $\sigma_N$, and $\tau_a$ are shown in the following Table:

| CASE NO. | $\sigma_H$* | $\sigma_h$* | $\sigma_V$* | $\alpha$ | $\beta$ | $\gamma_1$ | $\sigma_{N1}$* | $\tau_{a1}$* | $\gamma_2$ | $\sigma_{N2}$* | $\tau_{a1}$* |
|---|---|---|---|---|---|---|---|---|---|---|---|
| 1 | 48.26 | 24.13 | 31.71 | 0 | 30 | 0 | 26.03 | −3.284 | 90 | 48.26 | 0 |
| 2 | 48.26 | 24.13 | 31.71 | 0 | 45 | 0 | 27.92 | −3.792 | 90 | 48.26 | 0 |
| 3 | 48.26 | 24.13 | 31.71 | 90 | 60 | 90 | 24.13 | 0 | 0 | 35.85 | 7.164 |
| 4 | 48.26 | 24.13 | 31.71 | 60 | 90 | 90 | 30.16 | 10.448 | 0 | 31.71 | 0 |
| 5 | 48.26 | 24.13 | 31.71 | 75 | 90 | 90 | 25.75 | 6.032 | 0 | 31.71 | 0 |
| 6 | 48.26 | 24.13 | 31.71 | 75 | 60 | 105.94 | 24.88 | 3.248 | 15.94 | 36.31 | 7.651 |
| 7 | 48.26 | 24.13 | 31.71 | 75 | 75 | 102.07 | 25.41 | 4.918 | 12.07 | 33.05 | 4.869 |
| 8 | 48.26 | 24.13 | 31.71 | 10 | 30 | −9.41 | 26.0 | −3.266 | 80.59 | 48.12 | 1.550 |
| 9 | 48.26 | 24.13 | 31.71 | 20 | 30 | −18.92 | 25.84 | −3.207 | 71.08 | 47.74 | 2.999 |
| 10 | 48.26 | 24.13 | 31.71 | 0 | 25 | 0 | 25.48 | −2.904 | 90 | 48.26 | 0 |
| 11 | 48.26 | 24.13 | 31.71 | 0 | 35 | 0 | 26.62 | −3.563 | 90 | 48.26 | 0 |
| 12 | 60.32 | 24.13 | 31.71 | 0 | 30 | 0 | 26.03 | −3.284 | 90 | 60.32 | 0 |
| 13 | 36.19 | 24.13 | 31.71 | 0 | 30 | 0 | 26.03 | −3.284 | 90 | 36.19 | 0 |
| 14 | 48.26 | 27.58 | 31.71 | 0 | 30 | 0 | 28.61 | −1.791 | 90 | 36.19 | 0 |
| 15 | 48.26 | 20.68 | 31.71 | 0 | 30 | 0 | 23.44 | −4.776 | 90 | 48.26 | 0 |
| 16 | 48.26 | 24.13 | 35.16 | 0 | 30 | 0 | 26.89 | −4.776 | 90 | 48.26 | 0 |
| 17 | 48.26 | 24.13 | 28.27 | 0 | 30 | 0 | 25.16 | −1.791 | 90 | 48.26 | 0 |
| 18 | 44.29 | 22.06 | 27.75 | 0 | 30 | 0 | 23.48 | −2.463 | 90 | 44.29 | 0 |
| 19 | 52.22 | 26.19 | 35.68 | 0 | 30 | 0 | 28.57 | −4.105 | 90 | 52.22 | 0 |

*All pressures are in megapascals

The orientation $\alpha=0$, $\beta=30°$ (Case 1) provides a low $\sigma_N$ of 26.03 MPa compared to the minimum stress $\sigma_h=24.13$ MPa, well below the mean stress $\sigma_m=34.70$ MPa, and is an easy plane on which to hold the fracture diagonal. The shear stress of 3.28 MPa, though only moderate, should be adequate for satisfactory shear displacement to hold the fracture open. Increasing $\beta$ to 45° (Case 2) raises the shear stress slightly to 3.792 MPa but raises $\beta_N$ substantially, to 27.92 MPa. Case 3, with $\alpha=90°$, $\beta=60°$ illustrates a case where $\tau_a=0$ at the minimum $\sigma_N=24.13$ ($\tau_a=7.164$ MPa at the maximum $\sigma_N=35.85$), and would give a non-conducting non-diagonal fracture. Case 4 with $\alpha=60°$ and $\beta=90°$ gives a high shear stress of 10.448 MPa at a high $\sigma_N=30.16$ MPa. However, the orientation control on $\gamma$ is very small; when $\gamma$ varies from 90° to 0°, $\sigma_N$ increases only to 31.71 MPa, and $\tau_a$ goes to 0. Thus slight errors in orientation could lead to a non-diagonal fracture. Case 5, with $\alpha=75°$, $\beta=90°$, gives a fairly high shear stress of $\tau_a=6.032$ MPa at a low normal stress of $\sigma_N=25.75$ MPa. However, such a (horizontal) hole would be expensive to drill and very difficult to load with explosives. Cases 6 and 7 are less extreme cases ($\beta=60°$, 75°) which give high shear stress at low normal stress, and which would be slightly less expensive to drill and less difficult to load. As a first trial, Case 1 is selected with $\alpha=0$, $\beta=30°$, inasmuch as such a hole is easier to drill and load, and such orientation provides adequate shear stress and low enough normal stress to assure the production of a fracture in an axial plane.

Because there is some uncertainty in the magnitude and directions of the principal stresses, it is worthwhile to calculate the effects on $\sigma_N$ and $\tau_a$ that would be produced by errors of reasonable probability. The results of such calculations are shown in Cases 8–17. One of the principal stresses would be expected to be very nearly vertical. Because of the virtual absence of shear stresses at the surface, the only deviation from verticality of the nearly vertical principal stress would be due to variations in surface elevation. At formation depths which are large compared to variations in surface elevation, such deviations would be expected to be at most a few degrees. The effect of 5° changes in $\beta$ is shown in Cases 10 and 11. The probable error in the orientation of $\sigma_H$ is estimated to be about 10°. From Cases 8 and 9, showing values of $\alpha$ of 10° and 20°, the effect of an error in orientation of $\sigma_H$ is very small for the selected Case 1. The effects of errors in the magnitudes of the principal stresses are shown in Cases 12–17. The value of $\sigma_V$ is determined by the overburden and any error should be much less than the ±3.447 MPa changes shown in Cases 16 and 17. The value of $\sigma_h$ is given directly by mini-hydraulic fracturing tests, and should also be subject to less error than the ±3.447 MPa changes shown in Cases 14 and 15. The value of $\sigma_H$ is most subject to error because it must be calculated from the breakdown pressure and the tensile strength of the rock by means of fracture theory. Precautions must be taken to minimize the interfering effects of pre-existing fractures or weaknesses from joints. However, as shown in Cases 12 and 13, errors in $\sigma_H$ have no effect on $\sigma_N$ and $\tau_a$ for Case 1, and would only modify the strength of the orientation of $\gamma$ to the value $\gamma_1$, which is high in any case. The only concerns are a higher value of $\sigma_h$ or a lower value of $\sigma_V$, since the difference $\sigma_V-\sigma_h$ is the necessary driving force for the orienting effect on the fracture, as has already been noted.

Cases 18 and 19 in the table show the variation in stresses with depth from the top of the target formation at 1067 meters to the bottom at 1372 meters. The largest relative variation from top to bottom is the change in shear stress from 2.46 to 4.10 MPa, which is related to the greater change in $\sigma_V$ than in $\sigma_h$.

The full thickness of the formation is to be stimulated. The hole length L will be 305 meters/cos 30°=352 meters. To obtain sufficient stimulating effect the hole will be under-reamed to a diameter of 38 cm. The loading of aluminized water gel explosive will be about 149 kg per meter of length for a total charge of about 52,400 kg. A rough estimate of the transverse fracture length $L_t$ can be made on the basis of the volume of explosive gases (assumed cooled to rock temperature) produced compared to the fracture measured in the small-scale test described in Example 2. The aluminized water gel explosive produces a volume of 0.00229 cu m/kg at a pressure P=26.13 MPa equalling the value of $\sigma_N$, giving a volume per meter of hole length $A=0.00229\times149=0.341$ cu m/m. Assuming the same fracture aspect ratio obtained in Example 2, the predicted transverse length $L_t=58.3$ meters. Because of possible deviations from scaling, together with a better axial/transverse length ratio in the large-scale case, $L_t$ might be as large as 100 to 125 meters. Even if $L_t$ is this large, the charge length of L=325 meters gives a more than adequate $L/L_t$ ratio.

The explosive will be initiated with a time bomb and booster, and will be stemmed by a mud seal and coarse sand stemming to maintain pressure and protect the upper portion of the hole and top casing from damage. After detonation of the explosive, the stemming is removed by reverse circulation of air or other gas.

It is predicted that this treatment will substantially increase the gas flow over that which would have been obtained if a vertical well had been stimulated either by hydrofracturing or by conventional explosive stimulation, not only because of the much greater transverse length and the higher conductivity of the diagonal fracture, but also because the slanted fracture transverses a 152-meter horizontal width in the direction S40° E. Coring studies have shown that a majority of natural fractures in this formation are vertical and oriented so that their normals make small angles to the S40° E direction. These natural fractures contribute importantly to the large-scale effective permeability of the formation, the unfractured shale having a very low permeability. Thus the diagonal fracture provides a conductive path for gas flow in the direction in which the natural effective permeability is very low. In contrast, a sand-propped hydrofracture from a vertical well, being oriented normal to the S40° E direction in this region, would parallel the majority of natural fractures and would not provide the conductivity in the S40° E direction of low natural permeability that is required for a high gas output.

EXAMPLE 2

This example describes a small-scale experiment in which a long thin charge of explosive was detonated in a block of marble held under an externally applied stress system to simulate the stress differences that occur naturally in the earth because of tectonic stress.

A rectangular block of Napoleon marble (a recrystallized stylolytic limestone with very low permeability), approximately 0.76 m long in the North-South direction (N-S) by 0.76 m long in the East-West direction (E-W) and 0.51 m high was obtained with the "bedding planes" oriented perpendicular to the E-W direction. Because of the arrangement of the loading frame used to pressurize the block, the actual E-W direction simulated the vertical direction in the earth. An 8-mm-diameter access hole was drilled 0.34-m deep in the E face in a direction dipping 26½° down from the W direction, and was extended with a 1.6-mm diameter for another 0.19 m, at a location to cause the axis to pass through the center of the block. An explosive charge of extruded plastic explosive containing 80% PETN with a diameter of 0.66 mm, weighing 0.571 g/m length, with a length of 0.19 m was attached to a special electric blasting cap having a small 0.02 g base charge of RDX explosive contained in a confining lead carrier tube inside the coined-bottom cap shell. This charge assembly was lowered into the charge hole with the block positioned to make the hole vertical. The access hole was then stemmed with gypsum cement. The cap lead wires were brought up the access hole and along a groove to an edge of the block. The block was placed on top of a flat-jack on a bottom support structure with the block centered in a horizontal square frame made of reinforced I beams, capable of supporting loads up to 12 MN in both directions. Four flat-jacks were placed between the sides of the block and the horizontal frame and were held tightly against the block by a set of plates and wedges. A sixth flat-jack was placed on top of the block. A frame of I beams was placed on top of the top flat-jack and was secured to the bottom frame by heavy threaded rods and nuts. Hydraulic liquid was pumped into the flat-jacks through separate lines to each of the three pairs of opposing flat-jacks to pressurize the flat-jacks and thereby load the block to the desired stress levels in the three perpendicular directions, viz., 5.27 MPa in the vertical (T-B) direction, 15.62 MPa in the East-West (E-W) direction and 25.96 MPa in the North-South (N-S) direction. With the block under stress, the detonating cap leads were connected to a blasting machine and the explosive charge was detonated. The pressure was released from the flat-jacks, the top loading beam was removed, the tightening wedges were removed, and the block was removed from the frame. Subsequently the block was trimmed with a 1.52-m-diameter rock-cutting saw, to leave a central rectangular core 0.2 m in the T-B direction by 0.4 m in the N-S direction. A series of slabs were cut with the E faces of the slabs at distances from the E face of the block of 0.305 m, 0.343 m, 0.381 m, 0.419 m and 0.457 m. The E faces of the slabs were then polished and examined for fractures. Because the explosive charge was substantially smaller in diameter than the borehole, there was no highly fractured region in the neighborhood of the borehole. Essentially a single pair of fractures extended radially from each side of the hole. The fractures on all the E faces were traced onto a single diagram with the edges of the slabs fixed (that is, the fractures were projected onto a T-B, N-S plane). The multiple fracture tracing so obtained is shown in FIG. 5. The pair of large fractures extends radially from the charge substantially in the N-S direction, and conforms well to the hypothetical fracture plane which in this case includes the hole axis (slanted 26½° down from the E→W direction) and the N-S direction. In each tracing, the borehole has been bracketed to clarify its position. The 0.305-m surface is close to the top (initiation) end of the explosive charge, while the 0.457-m surface is close to the bottom of the charge. The greater extent of the fracture on the 0.305-m surface may be caused by the effect of the 0.02 g of explosive in the cap added to the effect of the 0.109 g main explosive charge. The only significant deviation of the fracture from the hypothetical fracture plane occurs near the S end of the trace on the 0.305-m surface, which is almost in line with the S tip of the fracture on the 0.343-cm surface. This very small portion of the fracture area is farthest removed from the charge center, by a distance exceeding one-half of the charge length. The tips of the fracture sections in some cases did not appear continuous, as indicated by the dashed line traces. The gaps are small islands of non-fractured material, and essentially all of the fracture is connected. The extent of the fractures, about 0.19 m in both the axial and transverse directions, is sufficiently small compared to the dimensions of the block, 0.76 m×0.76 m×0.51 m, to eliminate any effect on the fracture process from the boundaries of the block. The experiment simulates fracturing deep in the earth and far-removed from the surface.

As noted above, this experiment was designed to simulate the tectonic stress differences that might be encountered in the ground, with a borehole axis slanted 26½° from the vertical towards the direction of the least horizontal stress $\sigma_h$ (the experimental orientation having been dictated by the fact that the experimental frame had a higher stress capability in the horizontal directions). Orienting the xyz coordinate system shown in FIG. 1 and FIG. 4 to place x vertically up, y South, and z East in the experimental block, the hole axis orientation was given by $\alpha=0°$ and $\beta=26\frac{1}{2}°$. The hypothetical fracture plane had $\gamma=0°$, and the normal stress on the hypothetical fracture plane was $\sigma_N=7.34$ MPa, compared to the least principal stress $\sigma_h=5.27$ MPa and the mean stress $\sigma_m=15.62$ MPa. The shear stress $\tau$ on the hypothetical fracture plane was 4.14 MPa.

EXAMPLE 3

Another small-scale experiment, similar to that described in Example 2, was carried out, in which airflow measurements were made to demonstrate that the process created a conductive fracture.

The material, orientation, and dimensions of the marble block, borehole, and explosive charge were identical to those in Example 2 except that the explosive charge diameter was increased to 0.71 mm, giving a mass of 0.688 g/m length. In addition, two holes 6.35 mm in diameter were drilled vertically from the top face at two locations on a N-S line equidistant from the E and W faces, each spaced 0.038 m from the center of the top face. The holes were drilled to a depth of 0.292 m. Stainless steel tubing 6.34 mm in diameter was introduced to a depth of 0.216 m and was sealed into the rock with epoxy cement. The two pieces of tubing were bent and brought along grooves cut in the top face to the top-East edge of the block so that they could be brought out between the flat jacks when the block was loaded. The grooves were filled level with gypsum cement. These pieces of tubing made it possible to measure air flow into the block while under stress from one 76 mm length of exposed 6.35-mm-diameter hole into the block at a set inflow pressure, and out of a similar length of the second hole at atmospheric pressure. The open portion of each hole was in a location to be intercepted by the diagonal fracture created by the explosion. The block was loaded into the frame in an orientation like that in Example 2. However, the stresses applied in this case were 25.96 MPa in the E-W direction, rather than in the N-S direction as in Example 2, and 15.62 MPa in the N-S direction and 5.27 MPa in the T-B direction. The hypothetical fracture plane was identical to that in Example 2 but the normal stress on that plane was raised to 9.41 MPa and the shear stress to 8.27 MPa. Air flow measurements into one test hole and out of the other test hole were made with the block under stress, both before and after the explosive was detonated to form a diagonal fracture to intercept the two test holes. With an air pressure of 0.169 MPa applied to the inlet hole and a pressure of 0.1013 MPa (atmospheric pressure) at the outlet hole, the inflow was 0.159 cc/min before fracturing and 1.83 cc/min after fracturing, the flow rates being given in volume at atmospheric pressure. The outflow was 0.0152 cc/min before fracturing and 1.22 cc/min after fracturing. The increase in inflow by a factor of 11.5 and in outflow by a factor of 80.3 indicates that both test holes were intercepted by a fracture conductive to fluid flow while under a substantial normal stress (9.4 MPa).

The diagonal fracturing process can be carried out in two stages, the first stage comprising the usually much higher pressure break-down or fracture-initiation step, and the second stage the fracture growth. In some tectonic stress situations the pressure $P_r$ required to reopen fractures is higher than the pressure required to propagate the fractures. In diagonal fracturing the reopening pressure is $P_r=3\sigma_{N1}-\sigma_{N2}$ and the propagating pressure is $\sigma_{N1}$, where $\sigma_{N1}$ and $\sigma_{N2}$ are the normal stresses on the hypothetical fracture plane (miniplane) and the maxiplane (that plane containing the hole axis that has the maximum compressive normal stress acting on it). If $P_r$ is greater than $\sigma_{N1}$, it is necessary either to continue Stage 1 to a point where the transverse extent of fracturing allows enough shear displacement to hold the fractures open, or to start the second-stage pressurization with a high enough rate to raise the borehole pressure above the reopening pressure. Because the cross-sectional area is proportional to the square of the transverse length of the fracture, a small fraction (1–10%) of the total volume of fluid injected into the fracture will suffice to hold the fractures open after the first stage.

We claim:

1. A method of producing fluid-conductive fractures confined within an underground formation under tectonic stress comprising (a) drilling a hole into the formation so that a long portion of the hole, said portion being at least 50 diameters in length, in a zone to be fractured has an average axial orientation that is slanted with respect to the directions of the principal stresses existing in the formation, the orientation being selected to place the hypothetical fracture plane, defined as that plane containing the hole axis which has the least normal compressive stress acting on it, under a substantial shear stress and under a normal compressive stress which does not greatly exceed the minimum principal tectonic stress, and to place the maxiplane, defined as that plane containing the hole axis that has the maximum compressive normal stress acting on it, under a normal compressive stress that substantially exceeds the normal stress on the hypothetical fracture plane; and (b) pressurizing the surface of the formation which faces the long oriented portion of the hole rapidly over the entire length of said portion with a single continuous pulse of fluid at a pressure sufficient to cause fracturing of the formation.

2. The method of claim 1 wherein the long oriented portion of the hole is loaded with an explosive, and the explosive initiated, whereby the surface of the formation is pressurized by the gases produced by the decomposition of the explosive.

3. A method of claim 2 wherein the surface of the formation is pressurized by a detonation.

4. A method of claim 1, 2 or 3 wherein the long oriented portion of the hole is at least about 100 diameters in length.

5. A method of claim 1, 2 or 3 wherein the axial orientation of the long oriented portion of the hole is selected so as to place the hypothetical fracture plane under a shear stress of at least about 0.25 MPa and under a normal compressive stress that is less than the mean stress, and to place the maxiplane under a normal compressive stress that exceeds the normal compressive stress on the hypothetical fracture plane by at least 0.50 MPa.

6. A method of claim 5 wherein the hypothetical fracture plane is placed under a shear stress of at least about 0.75 MPa and under a normal compressive stress that is closer in magnitude to the minimum principal stress than to the mean stress, and the maxiplane is placed under a normal compressive stress that exceeds the normal compressive stress on the hypothetical fracture plane by at least 1.50 MPa.

7. A method of claim 1, 2, or 3 wherein the length, L, of the long oriented portion of the hole meets the requirement $$L > 14V^{\frac{1}{3}},$$

wherein V is the volume of fluid injected into the formation during pressurization after reaching the temperature of the formation and a pressure equal to the normal stress on the hypothetical fracture plane.

8. A method of claim 2 or 3 wherein the explosive is stemmed and the length, L, in meters, of the explosive meets the requirement $$L > 0.275\left(\frac{n\,WT}{P}\right)^{\frac{1}{3}},$$

wherein W is the mass of explosive in kilograms, n is the number of gram moles of gas produced per kilogram of explosive at the temperature T in Kelvins of the formation, and the pressure P, in megapascals, equal to the normal stress on the hypothetical fracture plane.

9. A method of producing fluid-conductive fractures confined within an underground formation under tectonic stress comprising (a) drilling a hole into the formation so that a long portion of the hole, said portion being at least 50 diameters in length, in a zone to be fractured has an average axial orientation that is slanted with respect to the directions of the principal stresses existing in the formation, the orientation being selected to place the hypothetical fracture plane, defined as that plane containing the hole axis which has the least normal compressive stress acting on it, under a substantial shear stress and under a normal compressive stress which does not greatly exceed the minimum principal tectonic stress, and to place the maxiplane, defined as that plane containing the hole axis that has the maximum compressive normal stress acting on it, under a normal compressive stress that substantially exceeds the normal stress on the hypothetical fracture plane; and (b) pressurizing the surface of the formation which faces the long oriented portion of the hole over the entire length of said portion with a single continuous pulse of fluid sufficiently rapidly to simultaneously exceed the breakdown pressure along the entire pressurized length, and to supply at least half the pressurizing fluid at a pressure exceeding the maximum value of $\sigma_{N1}$ (the normal stress acting on the hypothetical fracture plane).

10. A method of producing fluid-conductive fractures confined within an underground formation under tectonic stress comprising (a) drilling a hole into the formation so that a long portion of the hole, said portion being at least 50 diameters in length, in a zone to be fractured has an average axial orientation that is slanted with respect to the directions of the principal stresses existing in the formation, the orientation being selected to place the hypothetical fracture plane, defined as that plane containing the hole axis which has the least normal compressive stress acting on it, under a substantial shear stress and under a normal compressive stress which does not greatly exceed the minimum principal tectonic stress, and to place the maxiplane, defined as that plane containing the hole axis that has the maximum compressive normal stress acting on it, under a normal compressive stress that substantially exceeds the normal stress on the hypothetical fracture plane; and (b) pressurizing the surface of the formation which faces the long oriented portion of the hole rapidly over the entire length of said portion with a single continuous pulse of fluid generated by non-explosive means, the pressurizing fluid being supplied to the long oriented portion of the hole at a rate sufficient to cause the hole pressure to exceed the initial breakdown pressure by at least the difference between the largest and smallest values of the quantity $[(3\sigma_{N1}-\sigma_{N2})-[\Delta]H]$ along the pressurized length, wherein $\sigma_{N1}$ and $\sigma_{N2}$ are the normal stresses acting on the hypothetical fracture plane and the maxiplane, respectively and H is the hydraulic head of the pressurizing fluid, after which at least half of the pressurizing fluid is supplied at a rate sufficient to maintain the borehole pressure above the maximum value of $\sigma_{N1}$ along the pressurized length.

* * * * *

UNITED STATES PATENT OFFICE

CERTIFICATE OF CORRECTION

PATENT NO. : 4,220,205

DATED : September 2, 1980

INVENTOR(S) : David L. Coursen and George R. Cowan

It is certified that error appears in the above-identified patent and that said Letters Patent are hereby corrected as shown below:

Claim 10, line 30, delete "[ Δ ]".

Signed and Sealed this

*Twenty-fourth* Day of *March 1981*

[SEAL]

*Attest:*

RENE D. TEGTMEYER

*Attesting Officer*

*Acting Commissioner of Patents and Trademarks*